US009190779B2

(12) United States Patent
Zheng et al.

(10) Patent No.: US 9,190,779 B2
(45) Date of Patent: Nov. 17, 2015

(54) ELECTRICAL CONNECTOR HAVING BETTER ELECTRICAL PERFORMANCE

(71) Applicant: HON HAI PRECISION INDUSTRY CO., LTD., New Taipei (TW)

(72) Inventors: Xiao-Qin Zheng, Kunshan (CN); Lu Dai, Kunshan (CN); Dao-Zhen Bian, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/307,757

(22) Filed: Jun. 18, 2014

(65) Prior Publication Data

US 2014/0370751 A1 Dec. 18, 2014

(30) Foreign Application Priority Data

Jun. 18, 2013 (CN) ..... 2013 2 3481288 U

(51) Int. Cl.
*H01R 13/648* (2006.01)
*H01R 13/6581* (2011.01)
*H01R 12/72* (2011.01)

(52) U.S. Cl.
CPC ..... *H01R 13/6581* (2013.01); *H01R 12/724* (2013.01)

(58) Field of Classification Search
CPC ..... H01R 13/6581; H01R 12/724
USPC ..... 439/79, 607.35, 607.36, 607.37
See application file for complete search history.

(56) References Cited

U.S. PATENT DOCUMENTS

| | | | | |
|---|---|---|---|---|
| 6,039,449 | A * | 3/2000 | Dolan et al. | 359/871 |
| 8,932,081 | B2 * | 1/2015 | Kamarauskas et al. | 439/607.35 |
| 8,979,584 | B2 * | 3/2015 | Tsuchiya | 439/607.27 |
| 9,004,945 | B2 * | 4/2015 | Nagata et al. | 439/607.35 |
| 2014/0370752 | A1 * | 12/2014 | Ho | 439/607.35 |

FOREIGN PATENT DOCUMENTS

TW M388767 U 9/2010

* cited by examiner

*Primary Examiner* — Khiem Nguyen
(74) *Attorney, Agent, or Firm* — Ming Chieh Chang; Wei Te Chung

(57) ABSTRACT

An electrical connector includes a base seat, a plurality of contacts fixed in the base seat, and a shielding shell surrounding the base seat. The shielding shell defines a body portion retained in the base seat, a rear wall attached a rear face of the base seat and a plurality of soldering portions extending outside of the body portion. The electrical connector defines a mounting surface, a lower edge of the rear wall is higher than the mounting surface and defines at least one board-lock portion to improve the resonant frequency.

15 Claims, 7 Drawing Sheets

ELECTRICAL CONNECTOR HAVING BETTER ELECTRICAL PERFORMANCE

BACKGROUND OF THE INVENTION

1. Field of the Invention

The present invention relates to an electrical connector, and more particularly to an electrical connector having a shielding shell with better electrical performance.

2. Description of the Related Art

In the prior art, with the light, thin, short, small development trend of the electrical connector, the internal space of the electrical connector will be more narrow. Meanwhile, it needs to achieve high-speed in order to solve the transmission of big data. For example, it becomes a trend to increase a back wall to the shielding shell of the USB connector, however, it becomes an urgent problem that how to improve the structure of the back wall in order to achieve high-speed signal transmission.

Therefore, an improved electrical connector is highly desired to meet overcome the requirement.

BRIEF SUMMARY OF THE INVENTION

An object of the present invention is to provide an electrical connector having a shielding shell with better electrical performance.

In order to achieve above-mentioned object, an electrical connector includes a base seat, a plurality of contacts fixed in the base seat, and a shielding shell surrounding the base seat. The shielding shell defines a body portion retained in the base seat, a rear wall attached a rear face of the base seat and a plurality of soldering portions extending outside of the body portion. The electrical connector defines a mounting surface, a lower edge of the rear wall is higher than the mounting surface and defines at least one board-lock portion to improve the resonant frequency.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
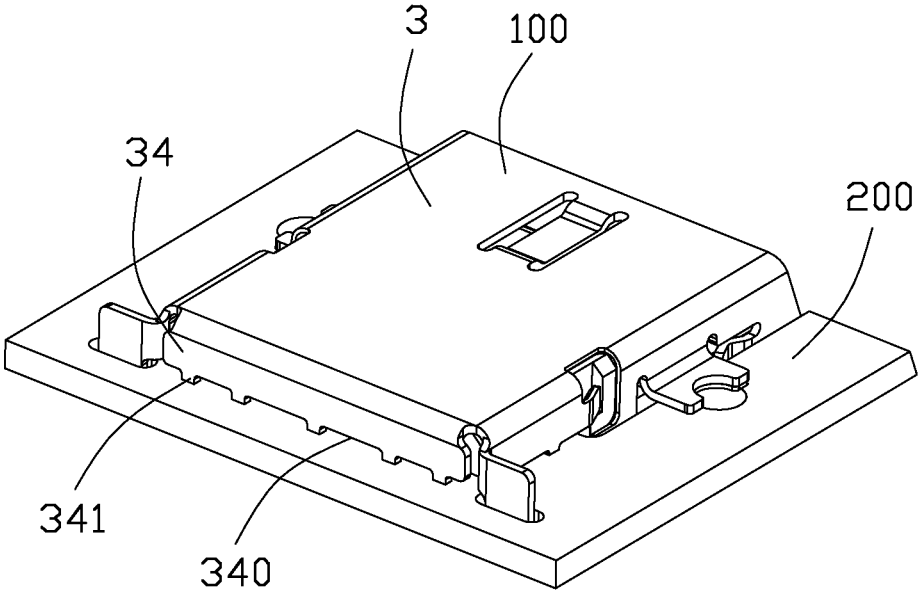
FIG. 1 is a perspective view showing an electrical connector mounted on a PCB of a first embodiment in accordance with the present invention.
Figure 2:
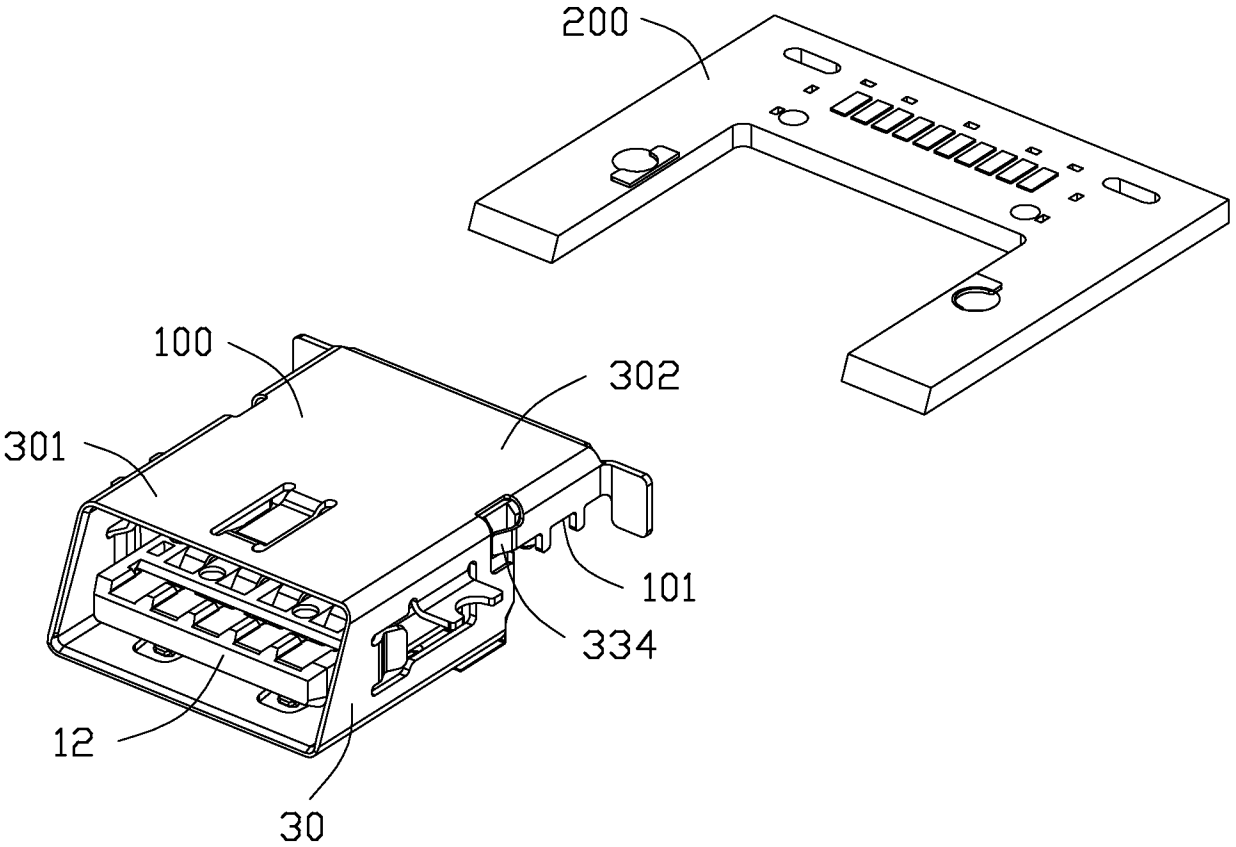
FIG. 2 is a partly exploded perspective view of the electrical connector shown in FIG. 1.
Figure 3:
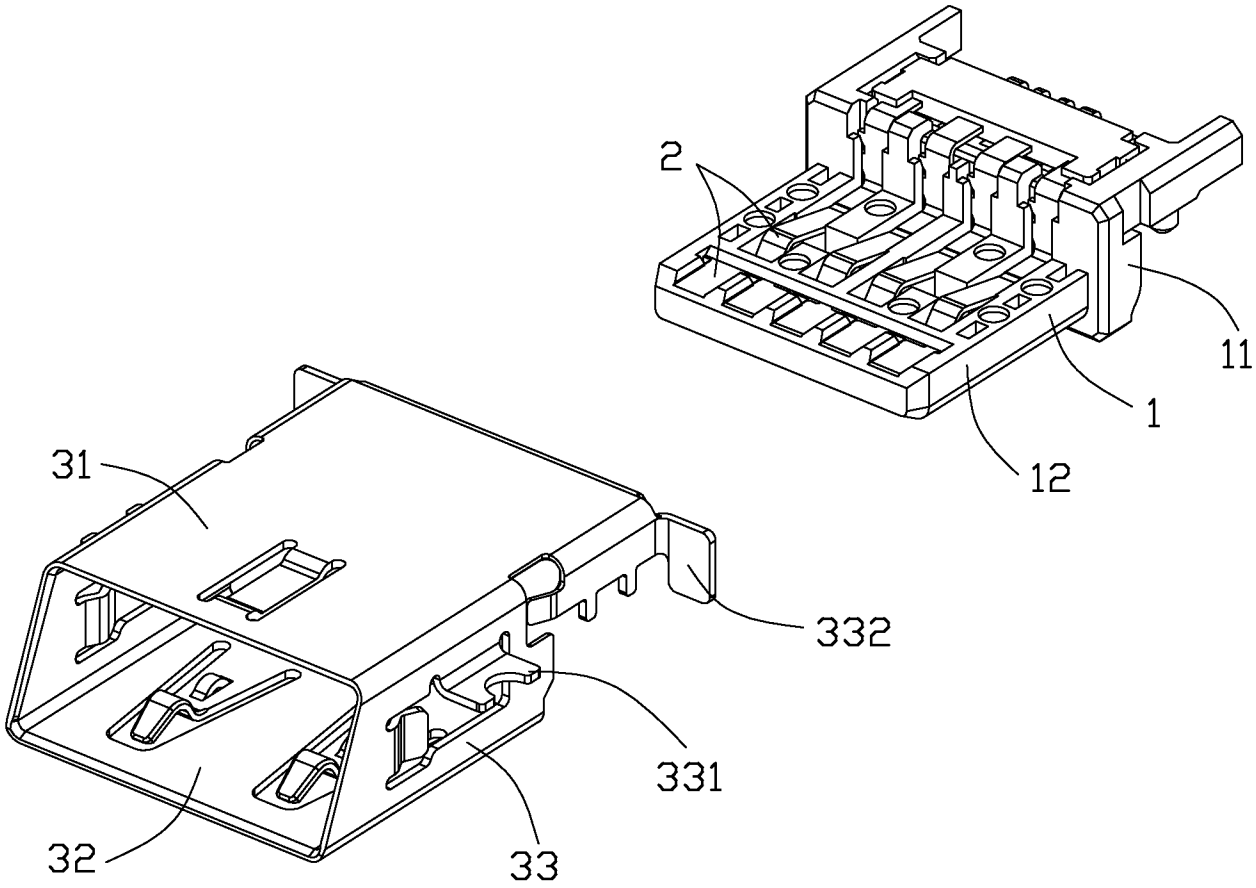
FIG. 3 is an exploded perspective view of the electrical connector shown in FIG. 1.
Figure 4:
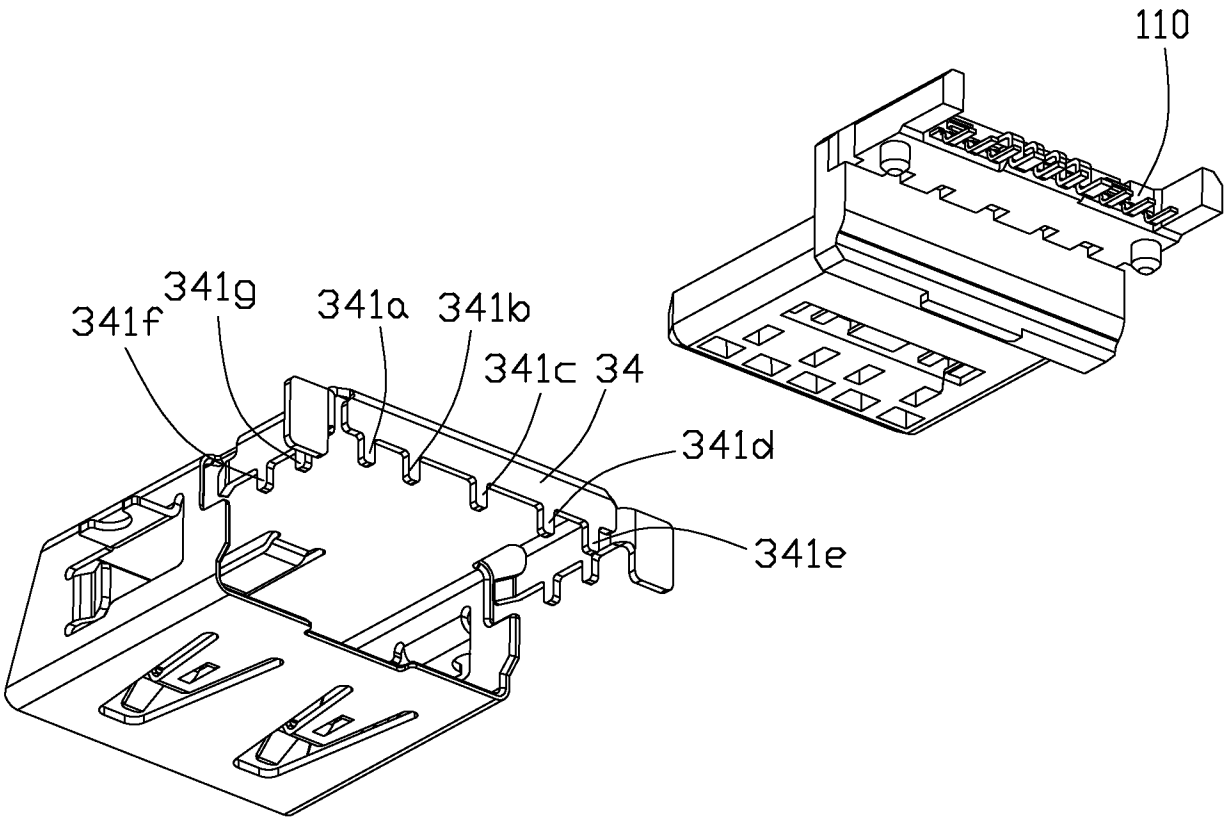
FIG. 4 is another exploded perspective view of the electrical connector shown in FIG. 1.

Reference will now be made to the drawing figures to describe a preferred embodiment of the present invention in detail. Referring to FIG. 1 and FIG. 4, an electrical connector

100 mounted on a print circuit board 200 in accordance with the present invention. The electrical connector 100 includes a base seat 1, a plurality of contacts 2 fixed in the base seat 1 and a shielding shell 3 surrounding the base seat 1, the base seat 1 defines a mounting surface 101 intimately confronting downwardly a top surface of the print circuit board 200. The shielding shell 3 defines a body portion 30 retained in the base seat, a rear wall 34 attached to a rear face 110 of the base seat. The lower edge 340 of the rear wall 34 is higher than the mounting surface 101 and defines a plurality of board-lock portions 341, in the preferred embodiment, the rear wall 34 defines five board-lock portions 341.

The body portion 30 of the shielding shell includes a top wall 31, a bottom wall 32 and a pair of side walls 33 disposed oppositely and connected the top wall and the bottom wall, the rear wall 34 is bending from the top wall 31 and each side wall 33 defines a first soldering portion 331 and a second soldering portion 332 arranged in a front-to-rear direction. In the preferred embodiment, the lower edge of the rear wall 34 is linear shape, a plurality of vertical pins extend downwardly to form the board-lock portions 341 and the board-lock portions 341 are connected with the soldering holes of the print circuit board 200 by perforation manner. The rear wall defines five board-lock portions 341*a*-341*e*, the board-lock portions are used for grounding so that it can improve the electrical performance of the electrical connector, in particular, increased to five, it can significantly improve the electrical performance of the electrical connector, but the board-lock portions continue to be increased, the electrical performance of the electrical connector is no obvious increased.

The base seat 1 defines a base portion 11 and a mating portion 12, the body portion 30 of the shielding shell 3 defines a frame portion 301 surrounding the mating portion 12 and a connecting portion 302 fixed in the base portion 11, the connecting portion 302 defines a pair of tabs 334 locking the base portion 11 inwardly. Each side wall of the connecting portion 302 defines a pair of board-lock portions 341*f*-341*g* which also can improve the electrical performance of the electrical connector.

The first soldering portion 331 is torn from the side wall 33 of the frame portion 301 and bending outwardly and horizontally to from a horizontal structure, the second soldering portion 332 is bending outwardly from the rear edge of the side wall 33 of the connecting portion 302 to form a vertical structure. Thus, the board-lock portions 341 and the second soldering portions 332 are arranged in a row. The bottom wall is the part of the shielding shell close to the print circuit board.

Figure 5:
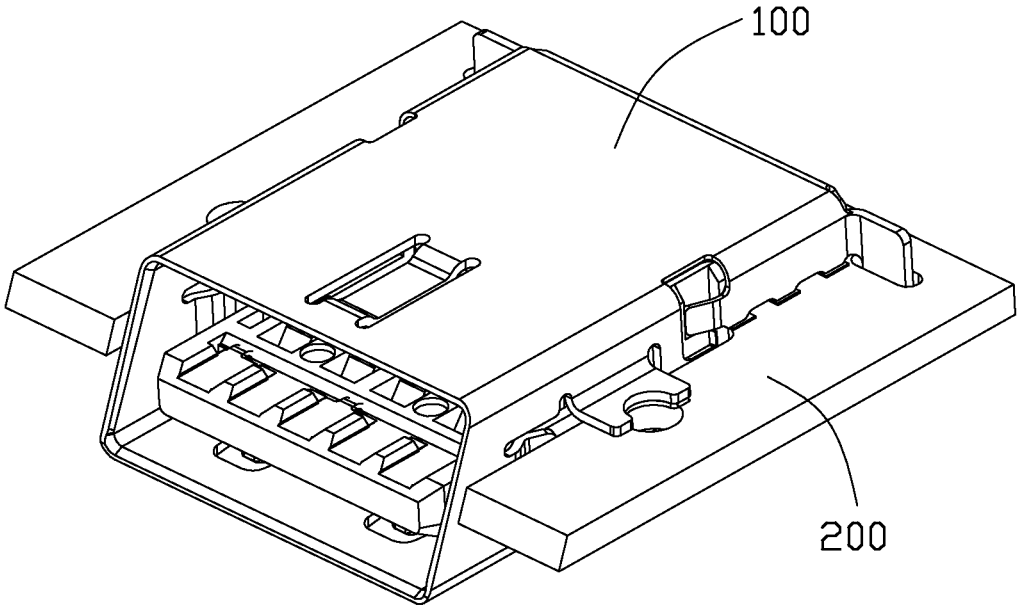
FIG. 5 is a perspective view showing an electrical connector mounted on a PCB of a second embodiment in accordance with the present invention.
Figure 6:
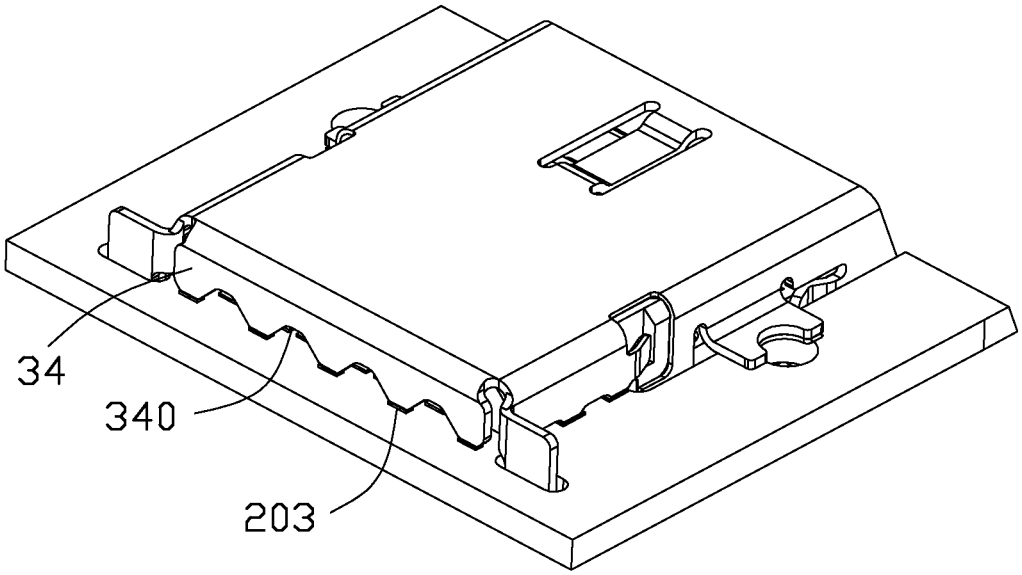
FIG. 6 is another perspective view of the electrical connector shown in FIG. 5.
Figure 7:
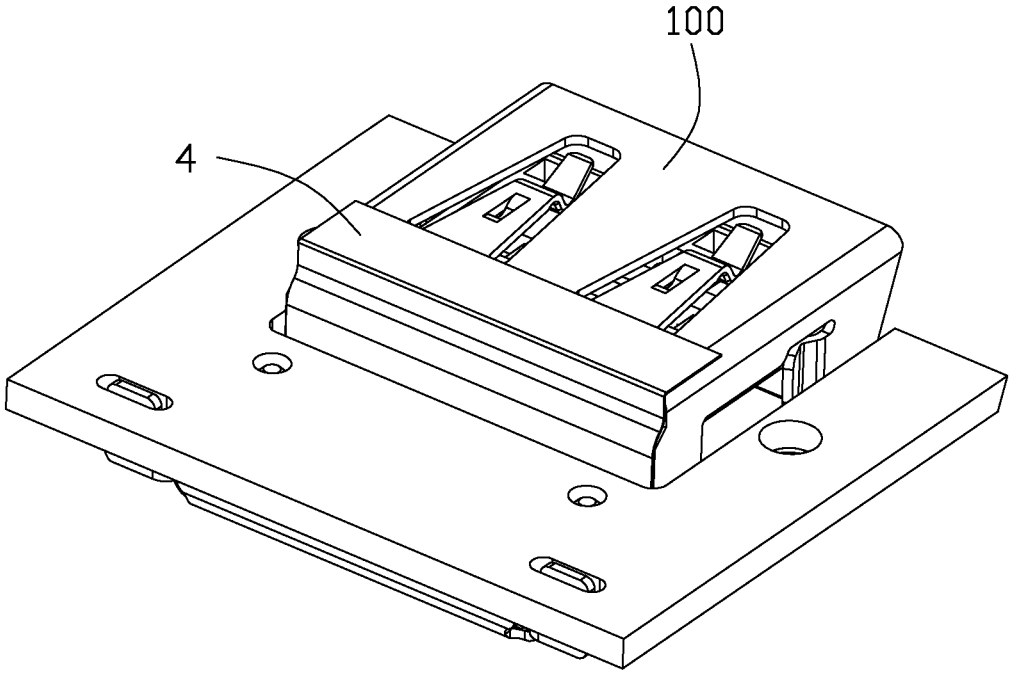
FIG. 7 is another perspective view of the electrical connector shown in FIG. 5.

FIG. 5 to FIG. 7 show a second embodiment of an electrical connector 100 mounted on a print circuit board 200 in accordance with the present invention. The structure of the electrical connector in the second embodiment is substantially same as the structure of the electrical connector in the first embodiment. The same structures adopt the same reference numerals and will not be described in detail, only describe the different points. The rear edge 340 of the rear wall 34 is serrated to form a plurality of overlapped portions 341, the overlapped portions 341 are connecting with the grounding pads 203 of the print circuit board 200 by Surface Mounting Technology. The electrical connector defines a protective layer 4 attached to the rear face of the base seat 1, the protective layer 4 around the rear portion of the base seat 1 to protect the soldering portions of the contacts from being contaminated.

The overlapped portions 341 can improve the resonance point of the electrical connector so as to make the resonance point moving to a higher frequency and reduce the amplitude of the crosstalk.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising: a base seat; a plurality of contacts fixed in the base seat; and a shielding shell surrounding the base seat and defining a body portion retained in the base seat, a rear wall attached a rear face of the base seat and a plurality of soldering portions extending outside of the body portion; wherein the electrical connector defines a mounting surface, a lower edge of the rear wall is higher than the mounting surface and defines at least one board-lock portion to improve the resonant frequency, wherein the rear wall defines five board-lock portions, wherein the body portion includes a top wall, a bottom wall and two opposite side walls connecting with the top wall and the bottom wall, the rear wall is bending from the top wall and each side wall defines a first soldering portion and a second soldering portion arranged in a front-to-rear direction, wherein the base seat defines a base portion and a mating portion, the body portion of the shielding shell defines a frame portion surrounding the mating portion of the base seat and a connecting portion fixed in the base portion, each side wall of the connecting portion defines at least one board-lock portion.

2. The electrical connector as described in claim 1, wherein the second soldering portion is bending outwardly from the rear edge of the connecting portion to form a vertical structure, the board-lock portions of the rear wall and the seconding soldering portions are arranged in a row.

3. The electrical connector as described in claim 2, wherein the first soldering portion is torn from the side wall of the frame portion and bending outwardly and horizontally to form a horizontal structure.

4. The electrical connector as described in claim 3, wherein the lower edge of the rear wall is linear shape and a plurality of vertical pins extend downwardly to form the board-lock portions.

5. The electrical connector as described in claim 1, wherein the electrical connector defines a protective layer attached the rear face of the base seat.

6. The electrical connector as described in claim 1, wherein the connecting portion defines a pair of tabs locking the base portion inwardly.

7. An electrical connector assembly comprising: a printed circuit board defining a notch; an electrical connector forming a front mating port and a rear mounting port a long a front-to-back direction, and including an insulative housing with an upside-down L-shaped base seat in the rear mounting port and a mating tongue forwardly extending from the base seat in the mating port; a plurality of contacts disposed in the housing with front contacting sections exposed in the mating port and rear mounting sections in the mounting port; and a metallic shell enclosing the housing to form said mating port which is essentially located in the notch, said shell further including a pair of side walls and a rear wall cooperating with each other to shield a rear horizontal portion of the base seat and be mounted upon a top surface of said printed circuit board; wherein the base seat defined a mounting face intimately confronting downwardly the top surface of the printed circuit board, and all said pair side walls and said rear wall are equipped with mounting devices to mechanically and electrically connect to the printed circuit board, wherein said shell forms a pair of horizontally extending front soldering portions around the front mating port, and a pair of horizontally extending rear soldering portions around the rear mounting port, and said pair of rear soldering portions are located at two opposite rear corners between the rear wall and the corresponding side walls, respectively, wherein said mounting devices are essentially board-locks extending through the printed circuit board in a vertical direction perpendicular to said front-to-back direction.

8. The electrical connector assembly as claimed in claim 7, wherein said pair of front soldering portions are configured with a surface mounting interface while the pair of rear soldering portions are configured with a through hole interface.

9. The electrical connector assembly as claimed in claim 7, wherein the pair of rear soldering portions unitarily extend from the corresponding side walls, respectively.

10. The electrical connector assembly as claimed in claim 7, wherein said connector is further equipped with a protective layer around a rear portion of the mating port.

11. The electrical connector assembly as claimed in claim 7, wherein the soldering sections of the contacts are of a surface mounting type.

12. The electrical connector assembly as claimed in claim 7, wherein each of the pair of side walls and the rear wall defines a bottom edge from which the mounting devices extend, and said bottom edge is higher than the mounting face.

13. The electrical connector assembly as claimed in claim 7, wherein the mounting sections of said contacts are located in front of said rear wall in said front-to-back direction.

14. The electrical connector assembly as claimed in claim 7, wherein said shell defines an upwardly slanting front opening to communicate the front mating port with an exterior forwardly in the front-to-back direction.

15. The electrical connector assembly as claimed in claim 7, wherein a pair of mounting posts unitarily extend downwardly from the mounting face and through the printed circuit board.

* * * * *